US010465566B2

(12) United States Patent
West et al.

(10) Patent No.: US 10,465,566 B2
(45) Date of Patent: Nov. 5, 2019

(54) SWITCHABLE ROCKER ARM WITH A TRAVEL STOP

(71) Applicant: DELPHI TECHNOLOGIES IP LIMITED, St. Michael (BB)

(72) Inventors: Joseph M. West, Rochester, NY (US); Chad E. Uckermark, Warwick, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 58 days.

(21) Appl. No.: 15/690,577

(22) Filed: Aug. 30, 2017

(65) Prior Publication Data

US 2019/0063267 A1 Feb. 28, 2019

(51) Int. Cl.

| | |
|---|---|
| ***F01L 1/18*** | (2006.01) |
| ***F01L 13/00*** | (2006.01) |
| *F01L 1/46* | (2006.01) |

(52) U.S. Cl.

CPC ..... *F01L 1/18* (2013.01); *F01L 1/185* (2013.01); *F01L 13/0005* (2013.01); *F01L 2001/186* (2013.01); *F01L 2001/467* (2013.01); *F01L 2013/105* (2013.01); *F01L 2105/00* (2013.01)

(58) Field of Classification Search

CPC ..... F01L 1/18; F01L 2001/186; F01L 1/185; F01L 13/0005; F01L 13/0036; F01L 2001/467

USPC ..... 123/90.16, 90.39, 90.44

See application file for complete search history.

(56) References Cited

U.S. PATENT DOCUMENTS

| | | | | |
|---|---|---|---|---|
| 5,544,626 | A * | 8/1996 | Diggs | F01L 1/185 123/198 F |
| 5,653,198 | A | 8/1997 | Diggs et al. | |
| 6,314,928 | B1 | 11/2001 | Baraszu et al. | |
| 6,532,920 | B1 | 3/2003 | Sweetnam et al. | |
| 7,305,951 | B2 * | 12/2007 | Fernandez | F01L 1/185 123/90.2 |
| 7,614,375 | B2 | 11/2009 | Tawaf et al. | |
| 7,798,113 | B2 | 9/2010 | Fischer et al. | |
| 7,882,814 | B2 * | 2/2011 | Spath | F01L 1/185 123/90.39 |
| 10,054,014 | B1 * | 8/2018 | West | F01L 1/185 |
| 2012/0266835 | A1 * | 10/2012 | Harman | F01L 1/185 123/90.39 |

* cited by examiner

*Primary Examiner* — Laert Dounis
*Assistant Examiner* — Kelsey L Stanek
(74) *Attorney, Agent, or Firm* — Joshua M. Haines

(57) ABSTRACT

A rocker arm includes an outer arm defining a bore; an inner arm which pivots relative to the outer arm, the inner arm defining a stop surface; a lost motion spring which biases the inner arm to pivot relative to the outer arm in a first direction; and a lock pin that slides within the bore between a coupled position in which the lock pin prevents the inner arm from pivoting relative to the outer arm past a predetermined position in a second direction which is opposite of the first direction and a decoupled position in which the lock pin permits the inner arm to pivot relative to the outer arm past the predetermined position in the second direction; such that the lock pin and the stop surface act together to limit the extent to which the inner arm pivots relative to the outer arm in the first direction.

14 Claims, 6 Drawing Sheets

SWITCHABLE ROCKER ARM WITH A TRAVEL STOP

TECHNICAL FIELD OF INVENTION

The present invention relates to a rocker arm for valve train of an internal combustion engine; more particularly to a rocker arm with an inner arm which selectively pivots relative to an outer arm, and even more particularly to such a rocker arm with a lock pin which includes a feature to limit the extent to which the inner arm pivots relative to the outer arm.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second and lesser valve lift mode, that is greater than no lift. It should be noted that the second valve lift mode may provide one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm. The inner arm is movably connected to the outer arm. It can be switched by a locking member, from a coupled mode wherein the inner arm is immobilized relative to the outer arm, to a decoupled mode wherein the inner arm can move relative to the outer arm. Typically, the outer arm of the switchable rocker arm is pivotally supported at a first end by the hydraulic lash adjuster. A second end of the outer arm operates against an associated engine valve for opening and closing the valve by the rotation of an associated eccentric cam lobe acting on an inner arm contact surface which may be a roller. The inner arm is connected to the outer arm for pivotal movement about the outer arm's second end with the contact surface of the inner arm disposed between the first and second ends of the outer arm. Typically, the locking member includes a locking pin disposed in a bore in the first end of the outer arm, the locking pin being selectively moved to engage the inner arm to thereby couple the inner arm to the outer arm when engaged, and decouple the inner arm from the outer arm when disengaged.

In a switchable two-step rocker arm, the outer arm typically supports a pair of rollers carried by a shaft. The rollers are positioned to be engaged by associated low-lift eccentric cam lobes that cause the outer arm to pivot about the hydraulic lash adjuster, thereby actuating an associated engine valve to a low-lift. The inner arm, in turn, is positioned to engage an associated high-lift eccentric cam lobe sandwiched between the aforementioned low-lift lobes. The switchable two-step rocker arm is then selectively switched between a coupled and a decoupled mode by the locking member. In the coupled mode, with the inner arm locked to the outer arm, the rotational movement of the central high-lift lobe is transferred from the inner arm, through the outer arm to cause pivotal movement of the rocker arm about the hydraulic lash adjuster, which in turn opens the associated valve to a high-lift. In the decoupled mode, the inner arm is no longer locked to the outer arm and is permitted to move relative to the outer arm against a lost motion spring that biases the inner arm away from the outer arm. In turn, the rollers of the outer arm engage their associated low-lift lobes. The rotational movement of the low-lift lobes is transferred directly through the outer arm, and the associated valve is reciprocated by the outer arm to a low-lift. It should be noted that high-lift and low-lift as used herein designates that high-lift encompasses one or both of greater magnitude of valve lift and greater duration of the valve being opened compared to low-lift.

A switchable deactivation rocker arm typically includes an outer arm and an inner arm. The inner arm supports a roller carried by a shaft. The roller is engaged by an eccentric lifting cam lobe for actuating an associated engine valve. Like the switchable two-step rocker arm, the switchable deactivation rocker arm is selectively switched between a coupled and a decoupled mode by a movable locking member. In the coupled mode, the inner arm of the switchable deactivation rocker arm is locked to the outer arm and the rotational movement of the associated lifting cam lobe is transferred from the inner arm, through the outer arm to cause pivotal movement of the rocker arm about the hydraulic lash adjuster which in turn opens the associated valve to a prescribed lift. In the decoupled mode, the inner arm becomes unlocked from the outer arm and is permitted to pivot relative to the outer arm against a lost motion spring. In the decoupled mode, the rotational movement of the lifting cam lobe is absorbed by the inner arm in lost motion and is not transferred to the outer arm. Thus, the associated valve remains closed when the switchable deactivation rocker arm is in its decoupled mode.

Unless constrained prior to installation of the switchable rocker arm in the internal combustion engine, it is possible for the inner arm to rotate sufficiently far so to allow the lost motion spring to become disassembled from the switchable rocker arm. In order to prevent the lost motion spring from becoming disassembled from the switchable rocker arm and to ensure that the inner arm is properly oriented for installation in the internal combustion engine, some switchable rocker arms have been designed to incorporate a travel limiter which limits the travel of the inner arm relative to the outer arm.

Also unless constrained, the force resulting from the lost motion spring acting on the camshaft through the inner arm can cause the hydraulic lash adjuster to leak down when the switchable rocker arm is in the coupled mode, thereby affecting the stiffness of the hydraulic lash adjuster and introducing mechanical lash into the valve train. In the same way the aforementioned disassembly issue is addressed, some switchable rocker arms have been designed to incorporate a travel limiter which limits the travel of the inner arm relative to the outer arm.

Examples of switchable rocker arms with a travel limiter are shown U.S. Pat. Nos. 5,544,626; 5,653,198; 6,314,928; 6,532,920; 7,614,375; 7,798,113 7,882,814. However the known travel limiters may be costly to implement, difficult to assemble, add to the number of components, and/or add to the overall size of the switchable rocker arm.

What is needed is a rocker arm which minimizes or eliminates one or more of the shortcomings as set forth above.

SUMMARY OF THE INVENTION

Briefly described, a rocker arm is provided for transmitting rotational motion from a camshaft to opening and closing motion of a combustion valve in an internal combustion engine. The rocker arm includes an outer arm defining a lock pin bore; an inner arm which selectively pivots relative to the outer arm, the inner arm defining a stop surface; a lost motion spring which biases the inner arm to pivot relative to the outer arm in a first direction; and a lock pin disposed within the lock pin bore such that the lock pin slides within the lock pin bore between 1) a coupled position in which the lock pin prevents the inner arm from pivoting relative to the outer arm past a predetermined position of the inner arm relative to the outer arm in a second direction which is opposite of the first direction and 2) a decoupled position in which the lock pin permits the inner arm to pivot relative to the outer arm past the predetermined position in the second direction; wherein the lock pin and the stop surface act together to limit the extent to which the inner arm pivots relative to the outer arm in the first direction.

BRIEF DESCRIPTION OF DRAWINGS

This invention will be further described with reference to the accompanying drawings in which.

DETAILED DESCRIPTION OF INVENTION

Figure 1:
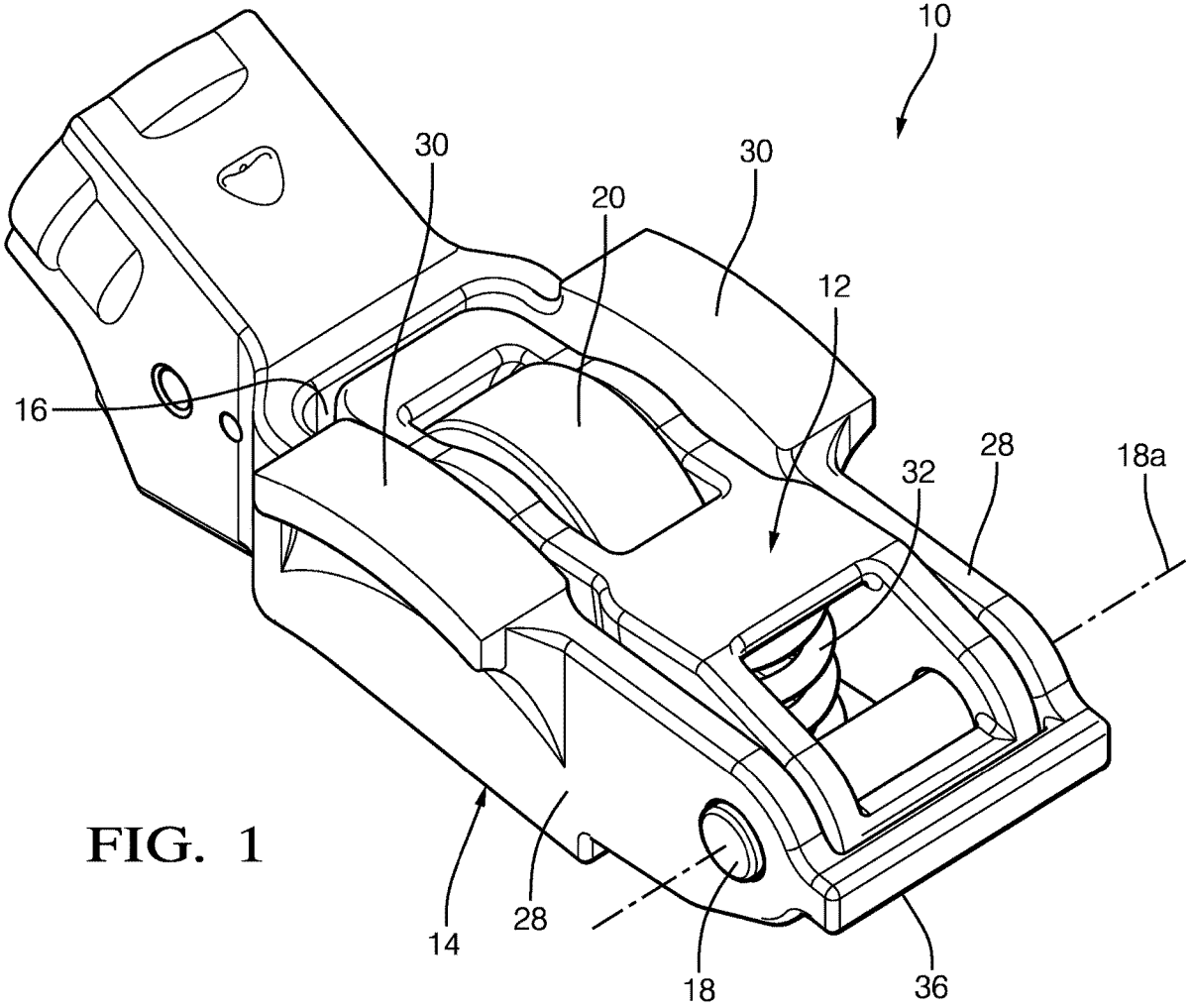
FIG. 1 is an isometric view of a rocker arm in accordance with the present invention.
Figure 2:
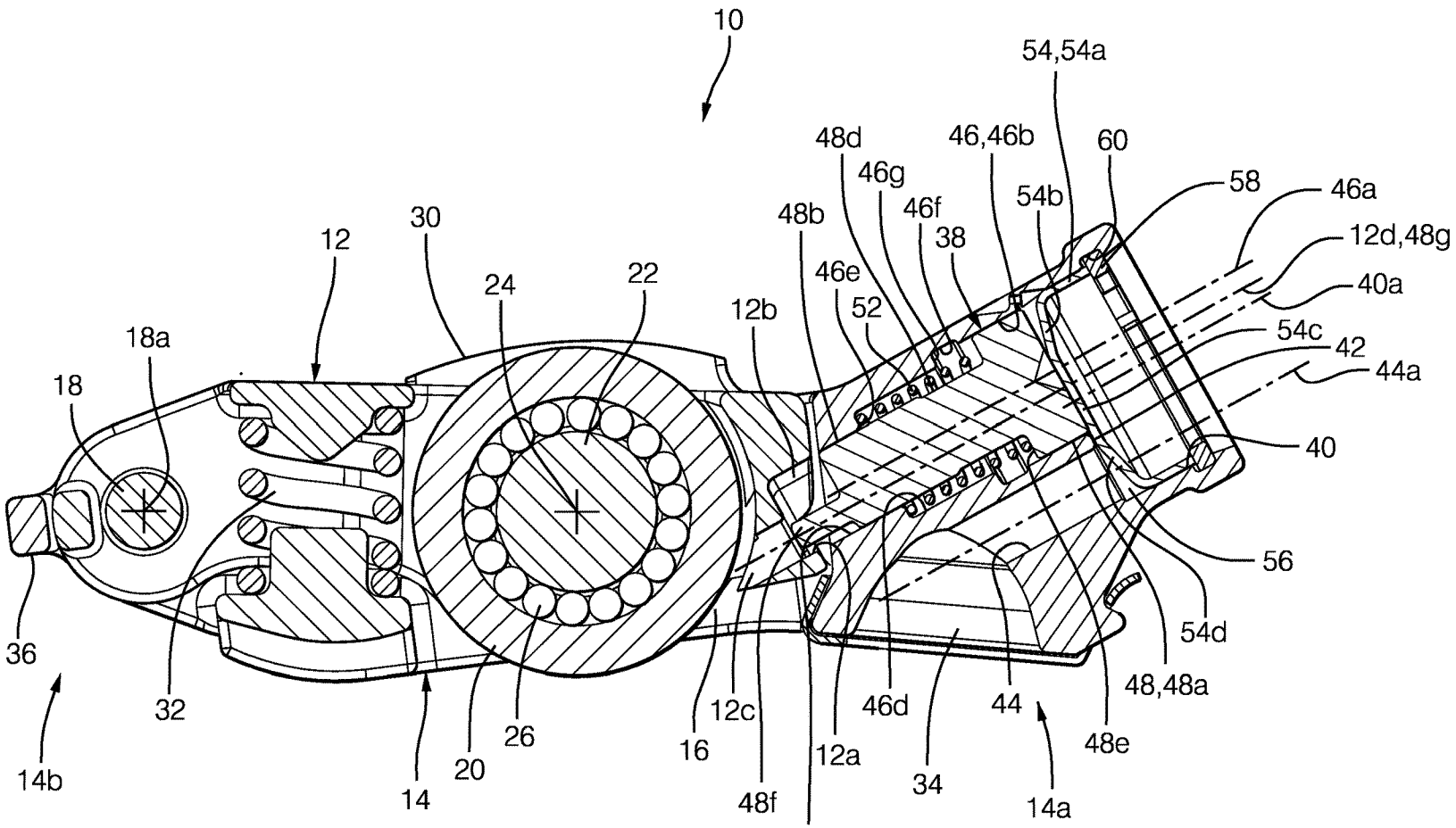
FIG. 2 is a cross-sectional view of the rocker arm of FIG. 1, taken through a first plane that is perpendicular to an axis about which an inner arm of the rocker arm pivots relative to an outer arm of the rocker arm, shown in a decoupled state.
Figure 3:
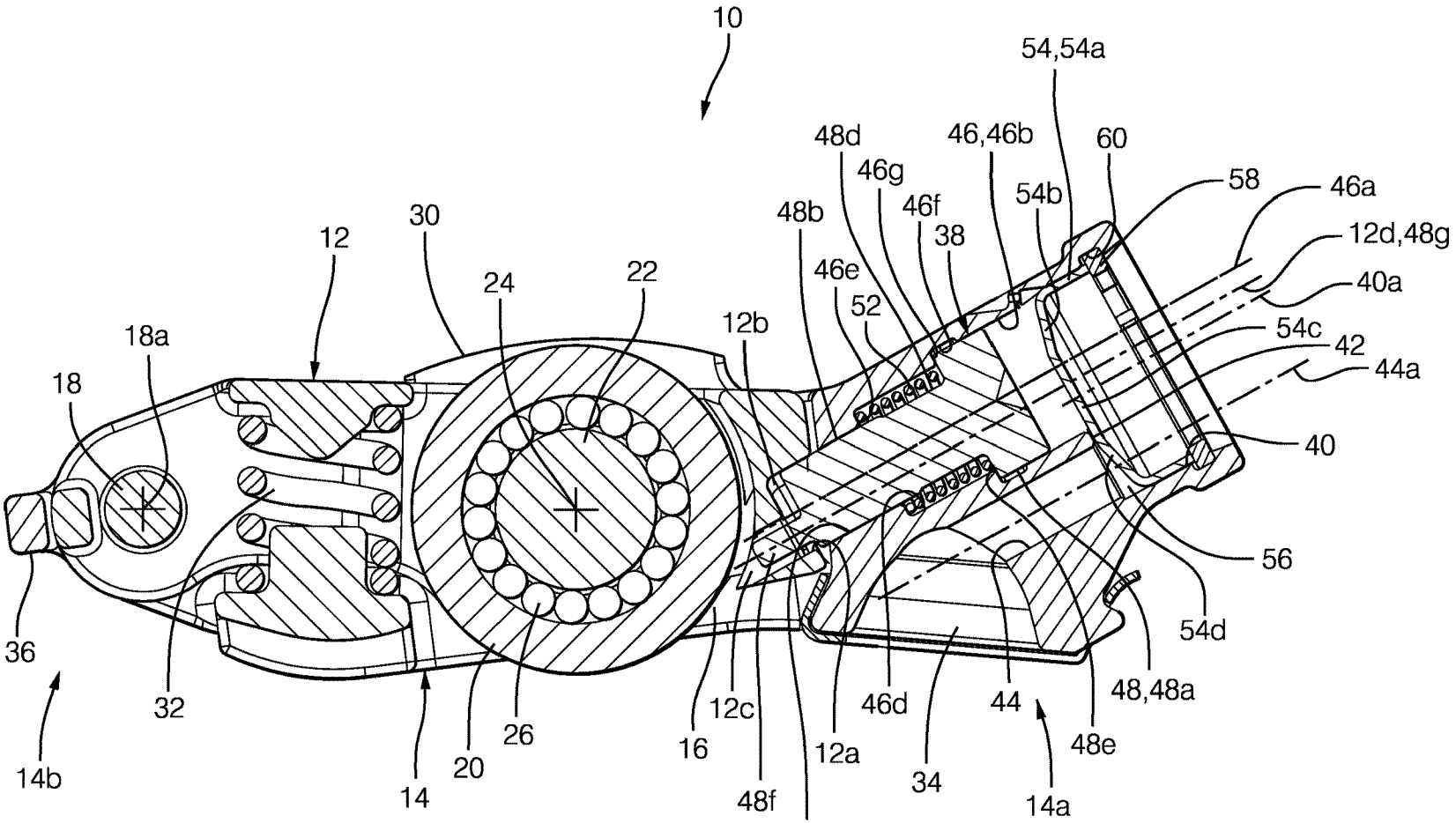
FIG. 3 is the cross-sectional view of FIG. 2, now showing the rocker arm in a coupled state.
Figure 4:
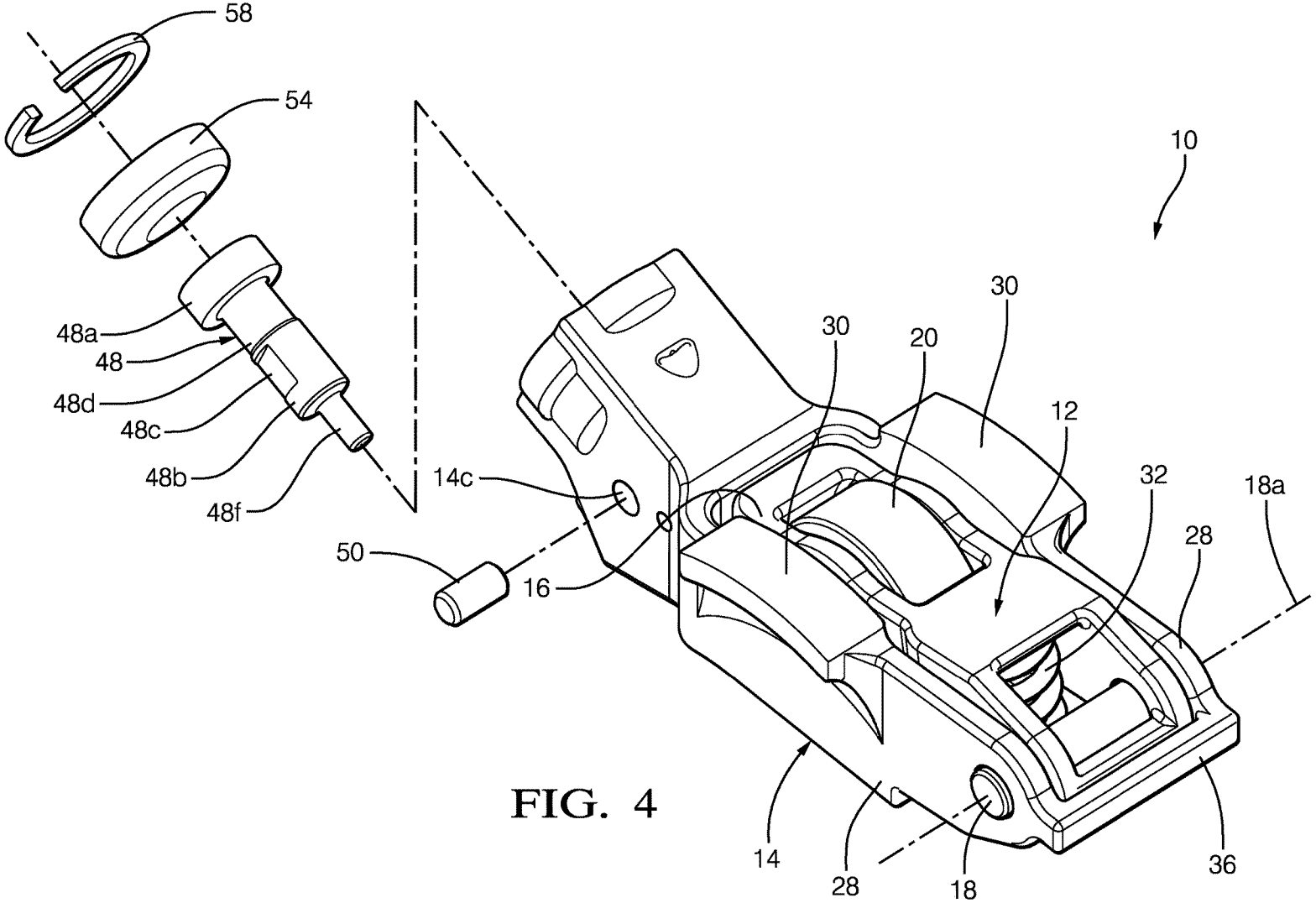
FIG. 4 is an isometric, partially exploded view of the rocker arm.
Figure 5:
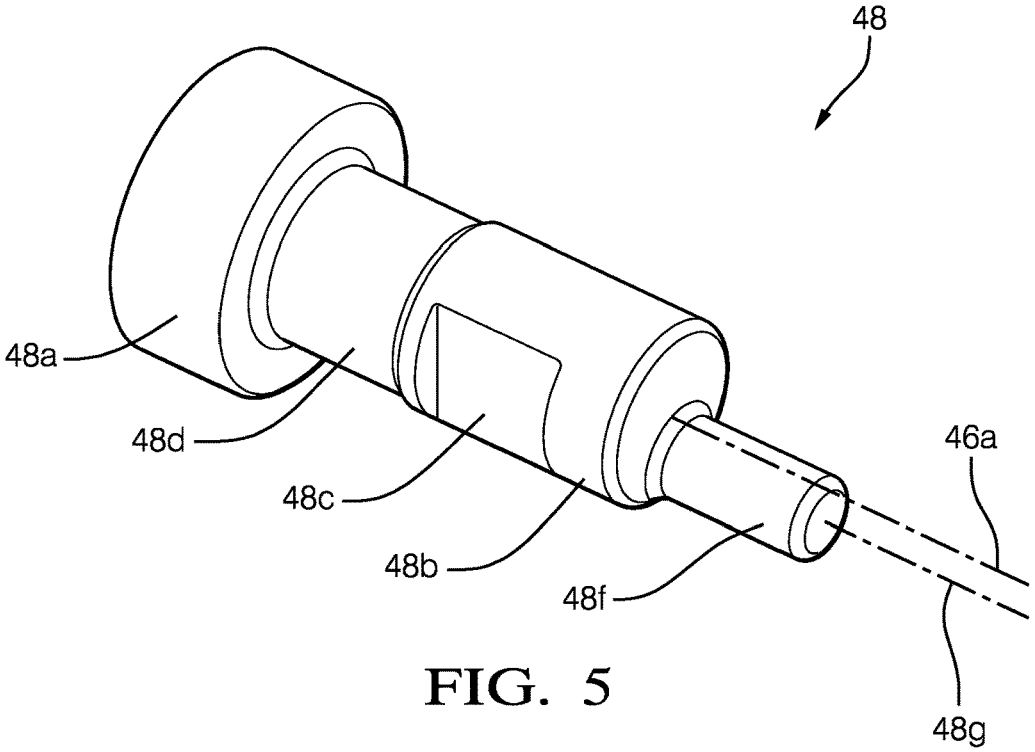
FIG. 5 is an isometric view of a lock pin of the rocker arm.
Figure 6:
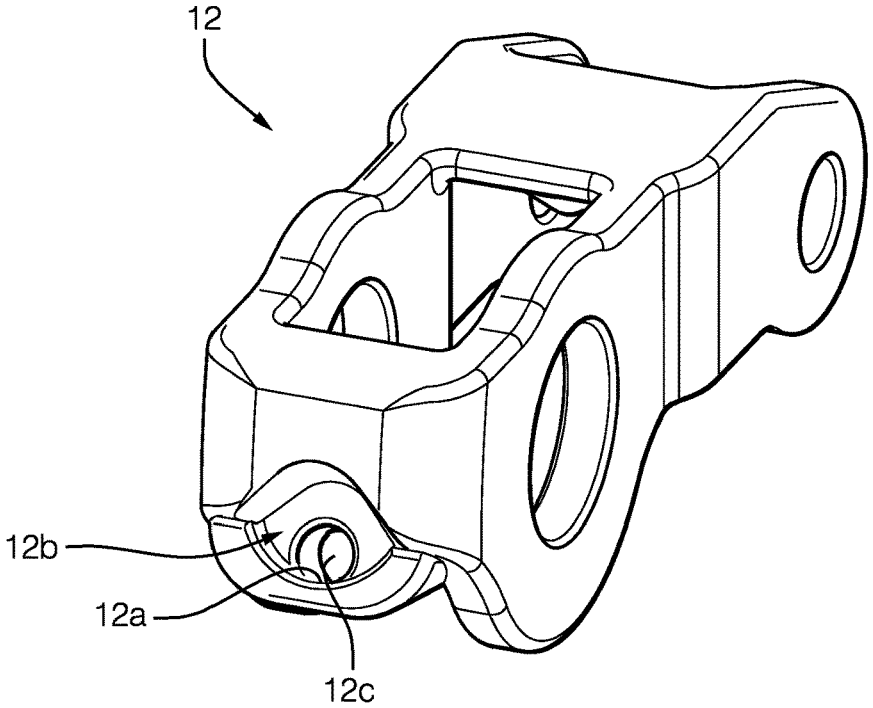
FIG. 6 is an isometric view of the inner arm of the rocker arm.

Referring initially to FIGS. 1-3, a rocker arm 10 in accordance with the invention is illustrated where rocker arm 10 is either a two-step rocker arm or a deactivation rocker arm, which may generically be referred to as a switchable rocker arm. Rocker arm 10 is included in valve train (not shown) of an internal combustion engine (not shown) in order to translate rotational motion of a camshaft (not shown) to reciprocating motion of a combustion valve (not shown). Rocker arm 10 includes an inner arm 12 that is pivotably disposed in a central opening 16 of an outer arm 14. Inner arm 12 selectively pivots within outer arm 14 about a pivot shaft 18 which is centered, and extends along, a pivot axis 18*a*. Inner arm 12 includes a contact surface illustrated as a roller 20 carried by a roller shaft 22 that is supported by inner arm 12 such that roller 20 and roller shaft 22 are centered about a roller shaft axis 24. Roller 20 is configured to follow a lobe of the camshaft, for example a high-lift lobe, to impart lifting motion on a respective combustion valve. A bearing 26 may rotatably support roller 20 on roller shaft 22 for following a cam lobe of a lifting cam of an engine camshaft (not shown). Bearing 26 may be, for example, a plurality of rollers or needle bearings. Roller shaft 22 is fixed to inner arm 12, by way of non-limiting example only by staking each end of roller shaft 22 in order to cause each end of roller shaft 22 to be increased in diameter to prevent removal from inner arm 12. Outer arm 14 includes two walls 28 positioned parallel to each other such that walls 28 are perpendicular to roller shaft axis 24 and such that walls 28 are spaced apart from each other to define central opening 16 therebetween. Outer arm 14 also includes followers 30 such that one follower 30 is fixed to each wall 28. As shown, followers 30 may be sliding surfaces, but may alternatively be rollers. Followers 30 are configured to follow respective lobes of the camshaft, for example low-lift lobes which impart lifting motion on a respective combustion valve or null lobes which do not impart lifting motion on a respective combustion valve. A lost motion spring 32 acts between inner arm 12 and outer arm 14 to pivot inner arm 12 away from outer arm 14 in a first direction. A socket 34 for pivotably mounting rocker arm 10 on a lash adjuster (not shown) is included at a first end 14*a* of outer arm 14 while a pad 36 for actuating a valve stem (not shown) is included at a second end 14*b* of outer arm 14. A latching arrangement 38 disposed within outer arm 14 at first end 14*a* thereof selectively permits inner arm 12 to pivot relative to outer arm 14 about pivot shaft 18 and also selectively prevents inner arm 12 from pivoting relative to outer arm 14 about pivot shaft 18. While the follower of inner arm 12 has been illustrated as roller 20, it should be understood that the follower of inner arm 12 may alternatively be a sliding surface as shown in U.S. Pat. No. 7,305,951 to Fernandez et al. Similarly, while followers 30 of outer arm 14 have been illustrated as sliding surfaces, it should be understood that followers 30 may alternatively be rollers as shown in U.S. Pat. No. 7,305,951. It should also be understood that the followers of inner arm 12 and outer arm 14 may all be rollers or may all be sliding surfaces.

Rocker arm 10 is selectively switched between a coupled state and a decoupled state by latching arrangement 38. In the coupled state as shown in FIG. 3, inner arm 12 is prevented from pivoting relative to outer arm 14 past a predetermined position of inner arm 12 relative to outer arm 14 in a second direction, shown as clockwise in FIG. 3, which is opposite from the first direction. In this way, in the coupled state, inner arm 12, and therefore roller shaft 22, is coupled to outer arm 14, and rotation of the lifting cam is transferred from roller 20 through roller shaft 22 to pivotal movement of outer arm 14 about the lash adjuster which, in turn, reciprocates the associated valve. In the decoupled state as shown in FIG. 2, inner arm 12 is able to pivot relative to outer arm 14 past the predetermined position in the first direction. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12 together with roller 20 and roller shaft 22 reciprocate within central opening 16, thereby compressing and uncompressing lost motion spring 32 in a cyclic manner such that lost motion spring 32 biases inner arm 12 to pivot relative to outer arm 14 in the first direction, shown as counterclockwise in FIG. 2.

Latching arrangement 38 will now be described in greater detail with continued reference to FIGS. 1-3, and now with additional reference to FIGS. 4-7. Latching arrangement 38 includes a connecting bore 40 which is centered about and extends along a connecting bore axis 40*a* into outer arm 14 such that connecting bore 40 is centered about connecting bore axis 40*a*. Connecting bore 40 extends from the outer surface of outer arm 14 to a connecting bore floor 42 which terminates connecting bore 40. Connecting bore floor 42 may be perpendicular to connecting bore axis 40*a* as shown. Connecting bore 40 may comprise multiple diameters, however, the cross-sectional shape of connecting bore 40 taken perpendicular to connecting bore axis 40*a* at any point along connecting bore axis 40*a* is preferably a circle.

Latching arrangement 38 also includes an oil supply bore 44 which is centered about, and extends along an oil supply bore axis 44*a*. The cross-sectional shape of oil supply bore 44 taken perpendicular to oil supply bore axis 44*a* at any point along oil supply bore axis 44*a* is preferably a circle, with the exception of where oil supply bore 44 meets socket 34 which provides for a non-symmetric cross-sectional shape. Oil supply bore 44 extends from socket 34 to connecting bore 40 such that oil supply bore 44 opens into connecting bore 40 through connecting bore floor 42. In this way, oil supply bore 44 provides fluid communication from socket 34 to connecting bore 40 and communicates pressurized oil to connecting bore 40. As is conventional in hydraulically actuated switchable rocker arms, oil supply bore 44 receives oil from the lash adjuster which is received within socket 34. As shown, oil supply bore axis 44*a* may be parallel to connecting bore axis 40*a*, however, oil supply bore axis 44*a* may alternatively be oblique to connecting bore axis 40*a*. Also as shown, oil supply bore axis 44*a* may be offset from connecting bore axis 40*a* in a direction perpendicular to connecting bore axis 40*a*.

Latching arrangement 38 also includes a lock pin bore 46 which is centered about, and extends along, a lock pin bore axis 46*a*. Lock pin bore 46 extends from central opening 16 to connecting bore 40 such that lock pin bore 46 opens into connecting bore 40 through connecting bore floor 42. Lock pin bore 46 may comprise multiple diameters, however, the cross-sectional shape of lock pin bore 46 taken perpendicular to lock pin bore axis 46*a* at any point along lock pin bore axis 46*a* is preferably a circle, with the exception of where lock pin bore 46 meets central opening 16 which provides for a non-symmetric cross-sectional shape. As shown, lock pin bore axis 46*a* is preferably parallel to connecting bore axis 40*a*. Also as shown, lock pin bore axis 46*a* may be offset from connecting bore axis 40*a* in a direction perpendicular to connecting bore axis 40*a*. As such, when oil supply bore axis 44*a* is parallel to connecting bore axis 40*a*, oil supply bore axis 44*a* is also parallel to lock pin bore axis 46*a* and when oil supply bore axis 44*a* is oblique to connecting bore axis 40*a*, oil supply bore axis 44*a* is also oblique to lock pin bore axis 46*a*. As illustrated in the figures, lock pin bore 46 and oil supply bore 44 are located laterally relative to each other and communicate with each other via connecting bore 40, i.e. oil supply bore 44 does not open directly into lock pin bore 46 and vice versa.

Lock pin bore 46 will now be described in greater detail. Lock pin bore 46 includes a first lock pin bore section 46*b* which is proximal to, and opens into connecting bore 40 through connecting bore floor 42. Lock pin bore 46 also includes a second lock pin bore section 46*c* which is proximal to, and opens into central opening 16. Second lock pin bore section 46*c* is preferably smaller in diameter than first lock pin bore section 46*b*. Lock pin bore 46 also includes a third lock pin bore section 46*d* which is immediately axially adjacent to second lock pin bore section 46*c* such that third lock pin bore section 46*d* is axially between first lock pin bore section 46*b* and second lock pin bore section 46*c*. Third lock pin bore section 46*d* is preferably larger in diameter than second lock pin bore section 46*c*, thereby forming a first lock pin bore shoulder 46*e* where third lock pin bore section 46*d* meets second lock pin bore section 46*c*. Third lock pin bore section 46*d* is preferably smaller in diameter than first lock pin bore section 46*b*. Lock pin bore 46 may also include a fourth lock pin bore section 46*f* which is immediately axially adjacent to third lock pin bore section 46*d* and to first lock pin bore section 46*b* such that fourth lock pin bore section 46*f* is axially between first lock pin bore section 46*b* and third lock pin bore section 46*d*. Fourth lock pin bore section 46*f* is larger in diameter than first lock pin bore section 46*b* and third lock pin bore section 46*d*, thereby forming a second lock pin bore shoulder 46*g* where fourth lock pin bore section 46*f* meets third lock pin bore section 46*d*.

Latching arrangement 38 also includes a lock pin 48 within lock pin bore 46 which slides along lock pin bore axis 46*a* between a coupled position shown in FIG. 3 and a decoupled position shown in FIG. 2 based on the magnitude of oil pressure supplied through oil supply bore 44. Lock pin 48 includes a first lock pin section 48*a* which is located within first lock pin bore section 46*b* such that first lock pin section 48*a* extends along, and is centered about, lock pin bore axis 46*a*. First lock pin section 48*a* is cylindrical and sized to mate with first lock pin bore section 46*b* in a close sliding fit which allows lock pin 48 to move axially within lock pin bore 46 while substantially preventing lock pin 48 from moving in a direction perpendicular to lock pin bore axis 46*a* and also substantially preventing oil from leaking between the interface of first lock pin section 48*a* and first lock pin bore section 46*b*. In this way, first lock pin section 48*a* acts as a hydraulic piston which allows pressurized oil from oil supply bore 44 to urge lock pin 48 into the coupled position shown in FIG. 3. In order to allow this relationship, first lock pin section 48*a* and first lock pin bore section 46*b* may need to be machined in a finish grinding operation to obtain suitable tolerances and surface finishes. As will be readily recognized by those of ordinary skill in the art, substantially preventing oil from leaking between the interface of first lock pin section 48*a* and first lock pin bore section 46*b* is an indication that some leakage may occur while still allowing sufficient pressure to act upon first lock pin section 48*a* to urge lock pin 48 into coupled position shown in FIG. 3. Any oil that may leak past the interface of first lock pin section 48*a* and first lock pin bore section 46*b* may be vented out of outer arm 14 through a vent passage that will not be further described herein. Lock pin 48 also includes a second lock pin section 48*b* which is supported within second lock pin bore section 46*c* such that second lock pin section 48*b* extends along, and is centered about lock pin bore axis 46*a*. Second lock pin section 48*b* includes a flat 48*c* thereon which is engaged by a complementary surface of a dowel pin 50 which is fixed within a complementary outer arm aperture 14*c* of outer arm 14 which extends into lock pin bore 46. In this way, dowel pin 50 extends into lock pin bore 46 thereby substantially preventing rotation of lock pin 48 about lock pin bore axis 46*a*. Consequently, flat 48*c* and dowel pin 50 act together as a means for anti-rotation of lock pin 48 about lock pin bore axis 46*a*. Second lock pin section 48*b* is cylindrical, with the exception of flat 48*c*, and sized to mate with second lock pin bore section 46*c* in a close sliding fit which allows lock pin 48 to move axially within lock pin bore 46 while substantially preventing lock pin 48 from moving in a direction perpendicular to lock pin bore axis 46*a*. When lock pin 48 is positioned in the coupled position shown in FIG. 3, a portion of second lock pin section 48*b* extends into central opening 16 and engages inner arm 12. While not shown, the tip of second lock pin section 48*b* which engages inner arm 12 may include a flat which engages inner arm 12. Lock pin 48 also includes a third lock pin section 48*d* which joins first lock pin section 48*a* and second lock pin section 48*b* such that third lock pin section 48*d* is smaller in diameter than first lock pin section 48*a* and second lock pin section 48*b*, thereby forming a lock pin shoulder 48*e* where third lock pin section 48*d* meets first lock pin section 48*a*. However, in an alternative, third lock pin section 48*d* may be omitted and lock pin shoulder 48*e* is formed where second lock pin section 48*b* meets first lock pin section 48*a*. Third lock pin section 48*d* extends along, and is centered about lock pin bore axis 46*a* such that third lock pin section 48*d* is cylindrical. Lock pin 48 also includes a fourth lock pin section 48*f*, hereinafter referred to as travel limiter 48*f*, which extends from second lock pin section 48*b* in a direction that is away from first lock pin section 48*a* such that second lock pin section 48*b* is located between third lock pin section 48*d* and travel limiter 48*f*. While travel limiter 48*f* is shown as being cylindrical, it should be understood that travel limiter 48*f* may be other shapes as well. Unlike first lock pin section 48*a*, second lock pin section 48*b*, and third lock pin section 48*d* which extend along, and are centered about, lock pin bore axis 46*a*, travel limiter 48*f* extends along, and is centered about, a travel limiter axis 48*g* which is parallel to, and laterally offset from, lock pin bore axis 46*a*. It should be noted that travel limiter axis 48*g* is laterally offset from lock pin bore axis 46*a* in the same direction that inner arm 12 moves when inner arm 12 compresses lost motion spring 32, i.e. the second direction. It should also be noted that a cross-sectional area of travel limiter 48*f* taken perpendicular to travel limiter axis 48*g* is less than a cross-sectional area of first lock pin section 48*a* taken perpendicular to lock pin bore axis 46*a*. Travel limiter 48*f* and its related function will be described in greater detail later.

Latching arrangement 38 also includes a return spring 52 within lock pin bore 46 which urges lock pin 48 into the uncoupled position shown in FIG. 2. Return spring 52 circumferentially surrounds third lock pin section 48*d* and a portion of second lock pin section 48*b* such that return spring 52 is held in compression between first lock pin bore shoulder 46*e* and lock pin shoulder 48*e*. In this way, when the pressure of oil acting on first lock pin section 48*a* is sufficiently low, return spring 52 urges lock pin 48 into the uncoupled state shown in FIG. 2. Conversely, when the pressure of oil acting on first lock pin section 48*a* is sufficiently high, lock pin 48 is urged by the oil pressure into the coupled state as shown in FIG. 3 whereby return spring 52 is compressed. As shown in FIG. 3, second lock pin bore shoulder 46*g* limits the travel of lock pin 48 in the coupled state by providing a surface for lock pin shoulder 48*e* to contact.

Figure 7:
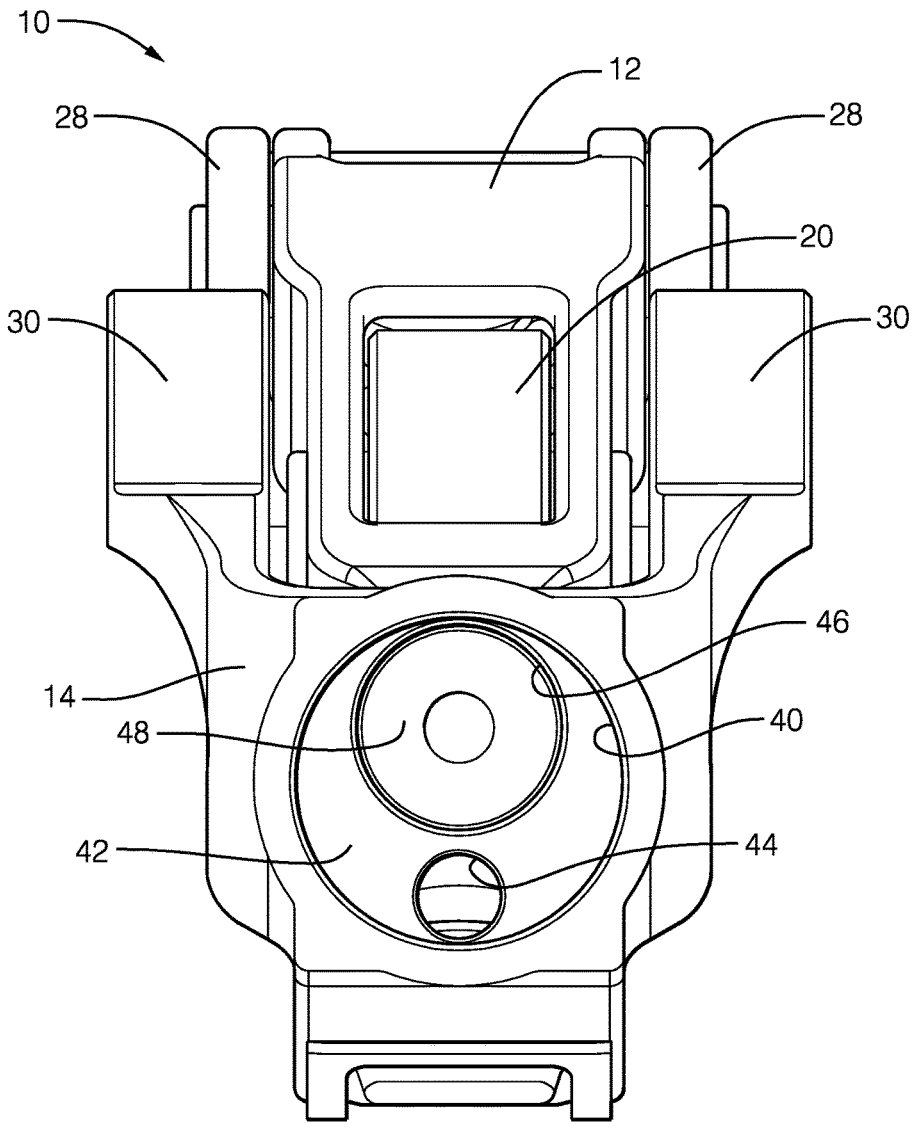
FIG. 7 is an isometric view of the rocker arm, shown with a retainer of a latching arrangement removed.

Latching arrangement 38 also includes a retainer 54 located within connecting bore 40 such that retainer 54 closes connecting bore 40 to define a chamber 56 within connecting bore 40 axially between retainer 54 and connecting bore floor 42 which provides fluid communication between oil supply bore 44 and lock pin bore 46. It should be noted that FIG. 7 is shown with retainer 54 removed in order to obtain a clear view of connecting bore 40, oil supply bore 44, and lock pin bore 46 viewed looking in the direction of connecting bore axis 40*a*. As shown in FIGS. 2 and 3, retainer 54 may be cup-shaped with an annular wall 54*a* centered about connecting bore axis 40*a* and an end wall 54*b* closing off the end of annular wall 54*a* that is proximal to connecting bore floor 42. Annular wall 54*a* is sized to mate with connecting bore 40 in an interference fit relationship which prevents oil from passing between the interface of annular wall 54*a* and connecting bore 40. End wall 54*b* includes a central section 54*c* surrounded by a peripheral section 54*d* such that central section 54*c* extends axially toward connecting bore floor 42 to a greater extent than peripheral section 54*d*. In this way, peripheral section 54*d* ensures that chamber 56 is sufficiently large to ensure adequate oil flow and pressure from oil supply bore 44 to lock pin bore 46. As shown, central section 54*c* may be perpendicular to connecting bore axis 40*a* while peripheral section 54*d* is oblique relative to connecting bore axis 40*a* such that peripheral section 54*d* tapers away from connecting bore floor 42 when moving from where peripheral section 54*d* meets central section 54*c* to where peripheral section 54*d* meets annular wall 54*a*. As best seen in FIG. 2, central section 54*c* acts as a travel stop for lock pin 48 when lock pin 48 is in the decoupled position such that lock pin 48 abuts the central section 54*c* while lock pin 48 is separated from peripheral section 54*d* when lock pin 48 is in the decoupled state. While the interference fit of annular wall 54*a* with connecting bore 40 may be sufficient to maintain the position of retainer 54 within connecting bore 40, additional retention may be desired. As shown, a clip 58 may be provided in a groove 60 of connecting bore 40 to ensure that the position of retainer 54 within connecting bore 40 is maintained. Alternative methods may be used to ensure retainer 54 that the position of retainer 54 within connecting bore 40 is maintained, for example, adhesives, welding, crimping, staking or combinations thereof.

In order to limit the extent to which inner arm 12 pivots relative to outer arm 14 in the first direction, i.e. counterclockwise as viewed in FIGS. 2 and 3, inner arm 12 includes a stop surface 12*a* upon which travel of inner arm 12 is limited by travel limiter 48*f* of lock pin 48 when lost motion spring 32 causes inner arm 12 to pivot relative to outer arm 14 in the first direction. However, due to travel limiter 48*f* of lock pin 48 being smaller in diameter than second lock pin section 48*b* and also due to travel limiter 48*f* being centered about travel limiter axis 48*g* which is laterally offset from lock pin bore axis 46*a* in the same direction that inner arm 12 moves when inner arm 12 compresses lost motion spring 32, i.e. the second direction, clearance is provided to allow inner arm 12 to pivot in the second direction when lock pin 48 is in the decoupled position as shown in FIG. 2. Stop surface 12*a* is partly defined by a recess 12*b* which extends part way into inner arm 12 and which receives second lock pin section 48*b* when lock pin 48 is in the coupled position as shown in FIG. 3. However, second lock pin section 48*b* reacts against a portion of recess 12*b* that is 180° around the perimeter of recess 12*b* from the portion against which travel limiter 48*f* reacts. An inner arm aperture 12*c* extends further into inner arm 12 such that inner arm aperture 12*c* initiates at the bottom of recess 12*b* and such that inner arm aperture 12*c* extends along, and is centered about, an inner arm aperture axis 12*d* which is normal to pivot axis 18*a*. It should be noted that inner arm aperture axis 12*d* is shown coincident with travel limiter axis 48*g* in FIGS. 2 and 3, however inner arm aperture axis 12*d* will pivot relative to travel limiter axis 48*g* as inner arm 12 pivots relative to outer arm 14, but inner arm aperture axis 12*d* will remain normal to pivot axis 18*a*. Inner arm aperture 12*c* further defines stop surface 12*a* and receives travel limiter 48*f* when lock pin 48 is in the coupled position as shown in FIG. 3 such that inner arm aperture 12*c* circumferentially surrounds travel limiter 48*f* when lock pin 48 is in the coupled position, where it should be noted that travel limiter 48*f* is retracted from inner arm aperture 12*c* when lock pin 48 is in the decoupled position. In this way, travel limiter 48*f* is able to engage stop surface 12*a* to limit the extent to which inner arm 12 pivots relative to outer arm 14 in the first direction when lock pin 48 is both in the coupled position and the decoupled position.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm defining a lock pin bore;

an inner arm which selectively pivots relative to said outer arm, said inner arm defining a stop surface;

a lost motion spring which biases said inner arm to pivot relative to said outer arm in a first direction; and a lock pin disposed within said lock pin bore such that said lock pin slides within said lock pin bore between 1) a coupled position in which said lock pin prevents said inner arm from pivoting relative to said outer arm past a predetermined position of said inner arm relative to said outer arm in a second direction which is opposite of said first direction and 2) a decoupled position in which said lock pin permits said inner arm to pivot relative to said outer arm past said predetermined position in said second direction; wherein said lock pin and said stop surface act together to limit the extent to which said inner arm pivots relative to said outer arm in said first direction.

2. The rocker arm as in claim 1 wherein said lock pin and said stop surface act together to limit the extent to which said inner arm pivots relative to said outer arm in said first direction both when said lock pin is in said coupled position and when said lock pin is in said decoupled position.

3. The rocker arm as in claim 1 wherein:

said lock pin bore extends along, and is centered about, a lock pin bore axis;

said lock pin includes a first lock pin section which is centered about said lock pin bore axis and which engages said inner arm in said coupled position, thereby preventing said inner arm from pivoting relative to said outer arm past said predetermined position of said inner arm relative to said outer arm in said second direction; and said lock pin includes a travel limiter which extends along, and is centered about, a travel limiter axis which is parallel to and laterally offset from said lock pin bore axis and which engages said stop surface, thereby limiting the extent to which said inner arm pivots relative to said outer arm in said first direction.

4. The rocker arm as in claim 3, wherein said travel limiter has a cross-sectional shape of a circle when sectioned by a plane that is perpendicular to said travel limiter axis.

5. The rocker arm as in claim 3 further comprising a means for anti-rotation which prevents rotation of said lock pin within said lock pin bore about said lock pin bore axis.

6. The rocker arm as in claim 3 wherein said inner arm defines an inner arm aperture which circumferentially surrounds said travel limiter when said lock pin is in said coupled position.

7. The rocker arm as in claim 6 wherein said lock pin is retracted from said inner arm aperture when said lock pin is in said decoupled position.

8. The rocker arm as in claim 6 wherein:

said inner arm selectively pivots relative to said outer arm about a pivot axis; and said inner arm aperture extends along, and is centered about, an inner arm aperture axis which is normal to said pivot axis.

9. The rocker arm as in claim 6 further comprising a means for anti-rotation which prevents rotation of said lock pin within said lock pin bore about said lock pin bore axis.

10. The rocker arm as in claim 3 wherein said travel limiter axis is laterally offset from said lock pin bore axis in said second direction.

11. The rocker arm as in claim 3 wherein a cross-sectional area of said travel limiter taken perpendicular to said travel limiter axis is less than a cross sectional area of said first lock pin section taken perpendicular to said lock pin bore axis.

12. A rocker arm for transmitting rotational motion from a camshaft to opening and closing motion of a combustion valve in an internal combustion engine, said rocker arm comprising:

an outer arm defining a lock pin bore;

an inner arm which selectively pivots relative to said outer arm, said inner arm defining a stop surface;

a lost motion spring which biases said inner arm to pivot relative to said outer arm in a first direction; and a lock pin disposed within said lock pin bore such that said lock pin slides within said lock pin bore between 1) a coupled position in which said lock pin prevents said inner arm from pivoting relative to said outer arm past a predetermined position of said inner arm relative to said outer arm in a second direction which is opposite of said first direction and 2) a decoupled position in which said lock pin permits said inner arm to pivot relative to said outer arm past said predetermined position in said second direction; wherein said lock pin and said stop surface act together to limit the extent to which said inner arm pivots relative to said outer arm in said first direction;

wherein said inner arm defines an inner arm aperture which circumferentially surrounds said lock pin when said lock pin is in said coupled position.

13. The rocker arm as in claim 12 wherein said lock pin is retracted from said inner arm aperture when said lock pin is in said decoupled position.

14. The rocker arm as in claim 12 wherein:

said inner arm selectively pivots relative to said outer arm about a pivot axis; and said inner arm aperture extends along, and is centered about, an inner arm aperture axis which is normal to said pivot axis.

* * * * *